US007118241B2

(12) United States Patent
Sohn

(10) Patent No.: US 7,118,241 B2
(45) Date of Patent: Oct. 10, 2006

(54) CLIP TYPE LIGHT EMITTER

(76) Inventor: Dae Up Sohn, 204ho, 222 Dong, Mokdong, Ap., 902-1, Mok-Dong, Yangcheon-Gu, Seoul (KR)

( * ) Notice: Subject to any disclaimer, the term of this patent is extended or adjusted under 35 U.S.C. 154(b) by 13 days.

(21) Appl. No.: 10/758,107

(22) Filed: Jan. 16, 2004

(65) Prior Publication Data

US 2004/0145888 A1 Jul. 29, 2004

(30) Foreign Application Priority Data

Jan. 22, 2003 (KR) ..... 20-2003-0002051

(51) Int. Cl.
*F21V 21/084* (2006.01)

(52) U.S. Cl. ..... 362/106; 362/190; 362/230; 362/396; 2/209.13

(58) Field of Classification Search ..... 362/103, 362/105, 106, 396, 190, 191, 230; 2/175.1, 2/20, 906
See application file for complete search history.

(56) References Cited

U.S. PATENT DOCUMENTS 4,298,913 A * 11/1981 Lozar ..... 362/103
5,357,409 A * 10/1994 Glatt ..... 362/105
5,485,358 A * 1/1996 Chien ..... 362/106
5,991,494 A * 11/1999 Otsuka ..... 386/37
6,168,286 B1 * 1/2001 Duffy ..... 362/106
6,659,618 B1 * 12/2003 Waters ..... 362/106
6,719,437 B1 * 4/2004 Lary et al. ..... 362/106

* cited by examiner

*Primary Examiner*—John Anthony Ward
(74) *Attorney, Agent, or Firm*—Birch, Stewart, Kolasch & Birch LLP

(57) ABSTRACT

The present invention relates to a clip type light emitter, and in particular to a clip type light emitter capable of enhancing a visual field at night by detachably engaging a clip type light emitter to a leisure cap (including hat) generally used for a mountain climbing or fishing or travel or various sports. The clip type light emitter comprises a casing forming a body; a plurality of lamps provided at a front side of the casing at regular intervals; a switch part provided in one side of the casing; a battery provided in the interior of the casing; and a clip provided in an upper side of the casing and having one side end integrally engaged with the casing and having a certain elastic force, wherein the clip type light emitter is detachably engaged to a leisure cap (including hat) used for a mounting climbing, a fishing or various outdoor leisure and sports.

4 Claims, 2 Drawing Sheets

CLIP TYPE LIGHT EMITTER

This Nonprovisional application claims priority under 35 U.S.C. § 119(a) on Patent Application No(s). 20-2003-0002051 filed in KOREA on Jan. 22, 2003, the entire contents of which are hereby incorporated by reference.

BACKGROUND OF THE INVENTION

1. Field of the Invention

The present invention relates to a clip type light emitter, and in particular to a clip type light emitter capable of enhancing a visual field at night by detachably engaging a clip type light emitter to a leisure cap (including hat) generally used for a mountain climbing or fishing or travel or various sports.

2. Description of the Background Art

Generally, people use a cap for protecting a face during a mountain climbing or fishing or preventing sweat falling down on the face.

In addition, a cap is commonly used during a travel or various sports for same purpose. Recently, the cap is used as a part of a fashion.

The cap is provided for various different purposes such as a fashion cap enhancing a fashion feeling, a winter cap for a cold weather, a safety cap for a safety of a worker, a cap for various sports, a leisure cap, etc.

Among the above various caps, in the case of the safety cap used for a safety when a worker works in a dark place such as a tunnel, a mine, etc., a certain lamp is installed at a front side of the cap for enhancing a visual field.

However, as shown in FIG. 1, there is not provided a certain light emitter device in the case of a leisure cap or a sports cap for a mountain climbing, a fishing, etc. except for the above safety cap. Therefore, there is additionally provided a certain lamp or flash for the people who enjoy a night climbing, a night fishing, etc. or the people who enjoys various sports at night in a place in which there are not provided any lighting devices.

In addition, when people walk in a side street in which there is not provided any streetlight, since a visual field is not fully provided, various accidents happen.

SUMMARY OF THE INVENTION

Accordingly, it is an object of the present invention to provide a clip type light emitter that overcomes the problems encountered in the conventional art.

It is another object of the present invention to provide a clip type light emitter capable of enhancing a visual field at night by detachably engaging a clip type light emitter to a leisure cap (including hat) generally used for a mountain climbing or fishing or travel or various sports.

To achieve the above objects, there is provided a clip type light emitter comprises a casing forming a body; a plurality of lamps provided at a front side of the casing at regular intervals; a switch part provided in one side of the casing; a battery provided in the interior of the casing; and a clip provided in an upper side of the casing and having one side end integrally engaged with the casing and having a certain elastic force, wherein the clip type light emitter is detachably engaged to a leisure cap (including hat) used for a mounting climbing, a fishing or various outdoor leisure and sports.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
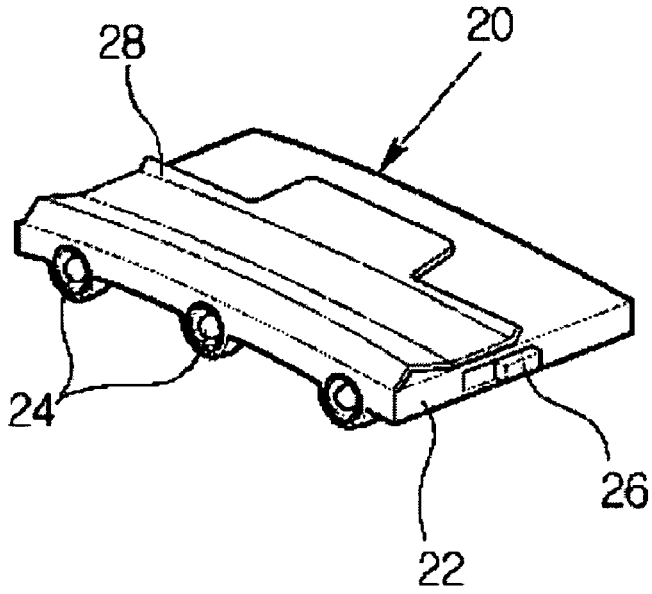
FIG. 1 is a perspective view illustrating a clip type light emitter according to the present invention.

FIG. 1 is a perspective view illustrating a clip type light emitter according to the present invention. As shown therein, in a light emitter 20, a casing 22 having a certain size forms a body. A plurality of lamps 24 are installed at a front side of the casing 22 at regular intervals. A switch part 26 is installed at one side of the casing 22. A battery (not shown) is installed in the interior of the casing 22.

In addition, a clip 28 having a certain elastic force is installed in an upper side of the casing 22 wherein the clip 28 is integrally formed with the casing.

Figure 2:
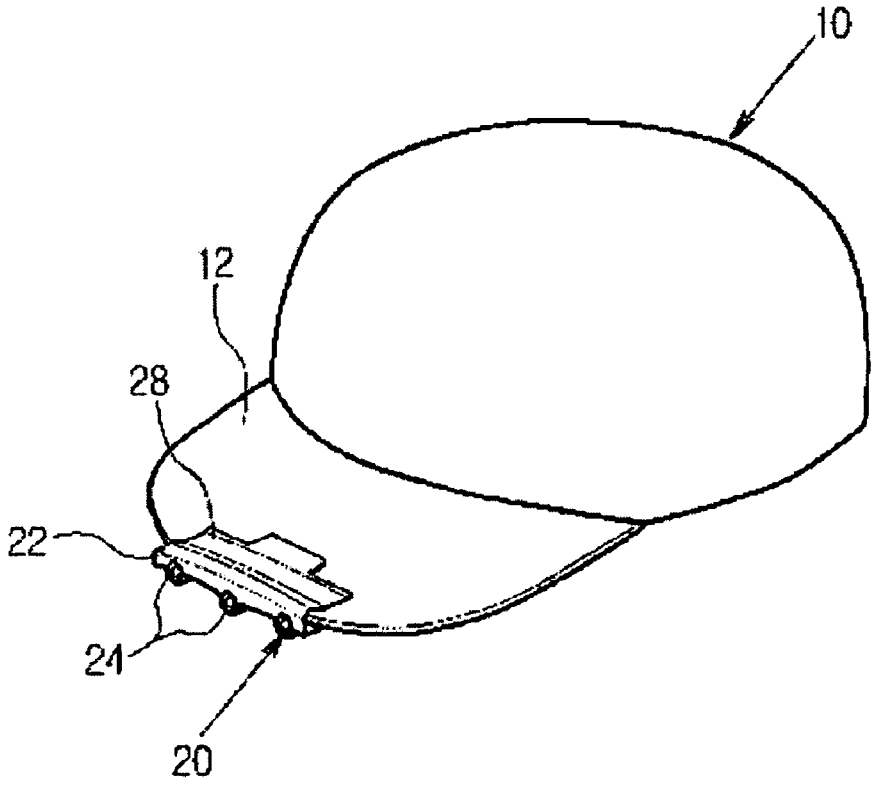
FIG. 2 is a perspective view illustrating a state that a clip type light emitter is engaged to a leisure cap according to the present invention.
Figure 3:
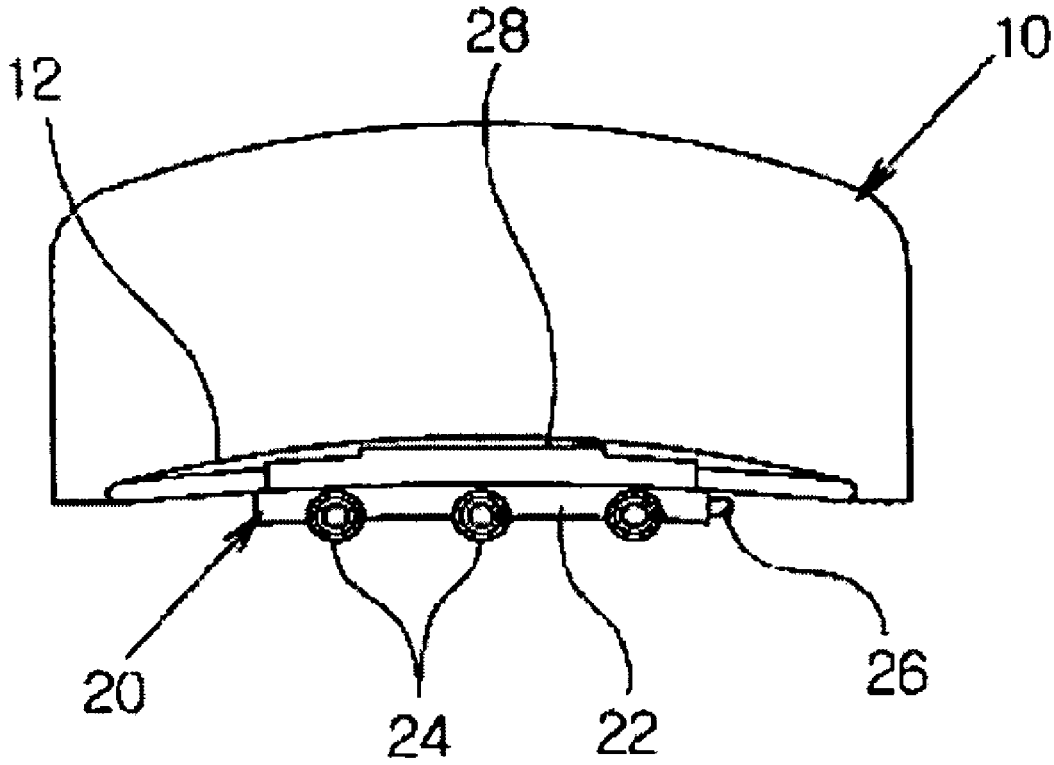
FIG. 3 is a front view illustrating the leisure cap with the clip type light emitter engaged thereto.

Therefore, as shown in FIGS. 2 and 3, when the clip type light emitter 20 is engaged to a front side of a visor of a cap 20 by a one-touch method, the clip type light emitter 20 is fixed to a front side of the visor 12 of the cap 10 based on the elastic force of the clip 28.

In a state that the clip type light emitter 20 according to the present invention is engaged to the visor 12, the lamps 24 are turned on and off by operating a switch part 26 when the user of the leisure cap 10 wants to turn on light for thereby obtaining a desired visual field in the front side.

In the above description, the clip type light emitter 20 according to the present invention is provided, wherein it is detachably engaged to the visor of the leisure cap. The clip type light emitter 20 may be engaged to a curtain, etc. during a power failure at home. In addition, the clip type light emitter 20 may be fixed to a certain portion of a tent at a camping place.

As described above, according to the clip type light emitter according to the present invention, a clip type light emitter is detachably engaged to an inner side of the visor of the leisure cap based on the on and off methods. Therefore, people can obtain a desired visual field by simply wearing a cap with the clip type light emitter without providing a certain lamp or a lighting device in a place in which a certain lighting device is not provided during a night mounting climbing or a nigh fishing. In addition, people enjoying various sports at night can use the clip type light emitter according to the present invention for thereby effectively enjoying sports based on an obtained good visual field.

In addition, in the case that people walk in a side street in which a streetlight is not provided, since it is possible to obtain a desired visual field by engaging the clip type light emitter according to the present invention to his cap, the people can walk in safe.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A clip type light emitter, comprising:

a casing forming a body;

a plurality of lamps provided at a front side of the casing at regular intervals;

a switch means provided in one side of the casing;

a battery provided in the interior of the casing; and a clip provided on an outer surface of the casing and having one side end integrally engaged with the casing to provide an elastic force, wherein said clip type light emitter is detachably engaged to a visor of a hat with said clip on an upper side of said visor and said casing on a lower side of said visor.

2. The clip type light emitter according to claim 1, wherein said light emitter is attached to a visor of a cap by pushing and is removed by pulling.

3. The clip type light emitter according to claim 1, wherein said lamps provide a range that is the same as a view angle of a user.

4. The clip type light emitter according to claim 1, wherein said clip is deformed to receive said visor between said clip and said casing.

* * * * *